US005361523A

United States Patent [19]

Robinson

[11] Patent Number: 5,361,523

[45] Date of Patent: Nov. 8, 1994

[54] CONCEALED DISPLAY FOR A GARMENT

[76] Inventor: Elizabeth M. Robinson, 3801 Brooklyn NE #C130-4, Seattle, Wash. 98105

[21] Appl. No.: 49,627

[22] Filed: Apr. 19, 1993

Related U.S. Application Data

[63] Continuation of Ser. No. 817,662, Jan. 7, 1992, abandoned.

[51] Int. Cl.[5] ..... G09F 21/02

[52] U.S. Cl. ..... 40/586; 2/95

[58] Field of Search ..... 40/586; 2/115, 94, 108, 2/244, 95

[56] References Cited

U.S. PATENT DOCUMENTS

| | | | |
|---|---|---|---|
| 2,582,772 | 1/1952 | Egbert | 2/95 |
| 2,657,389 | 11/1965 | Gross | 2/95 X |
| 2,786,207 | 3/1957 | Abraham | 2/115 |
| 3,381,307 | 5/1968 | Shingler . | |
| 3,905,071 | 9/1975 | Brumlik | 24/706.4 |
| 4,277,848 | 7/1981 | Boehland . | |
| 4,710,981 | 12/1987 | Sanchez . | |
| 4,864,656 | 9/1989 | Nesse . | |
| 4,969,214 | 11/1990 | Cohen . | |
| 4,985,935 | 1/1991 | Hur . | |
| 4,991,233 | 2/1991 | Hall . | |
| 4,999,848 | 3/1991 | Oney . | |

FOREIGN PATENT DOCUMENTS

| | | | |
|---|---|---|---|
| 1464680 | 1/1967 | France | 2/115 |

*Primary Examiner*—Kenneth J. Dorner
*Assistant Examiner*—Joanne Silbermann
*Attorney, Agent, or Firm*—Jensen & Puntigam

[57] ABSTRACT

A garment having a front opening including a selectively hidden display which, when the garment is fully open, may extend the full width and yet is hidden when the garment is closed.

2 Claims, 3 Drawing Sheets

FIG. 6
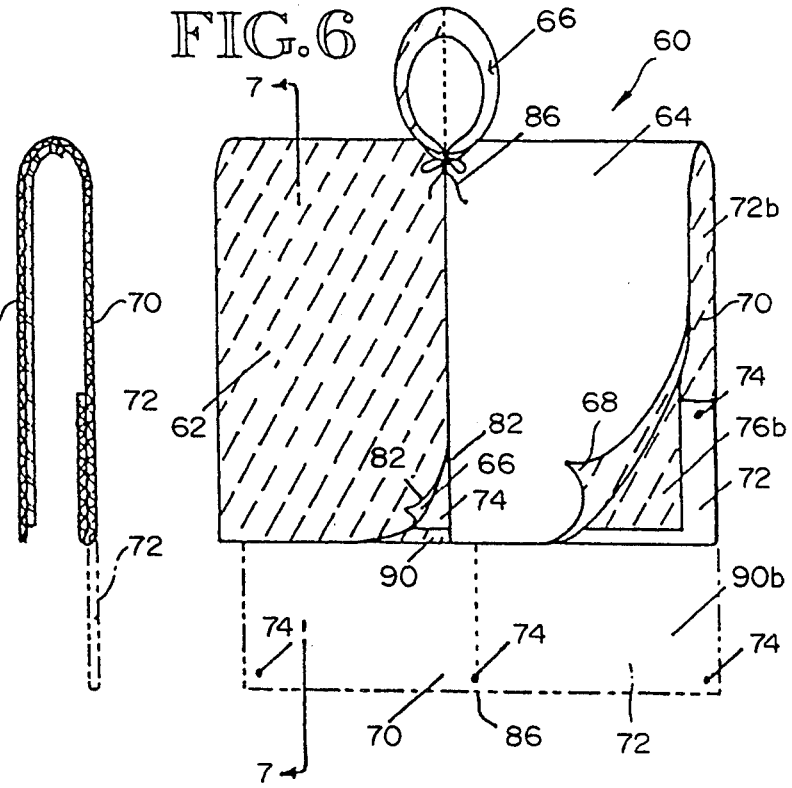
FIG. 7
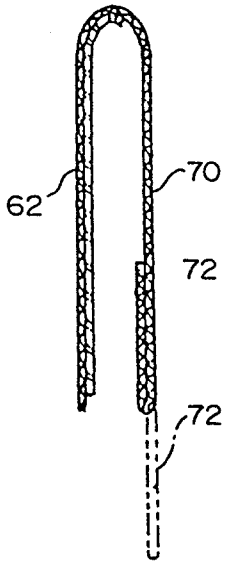
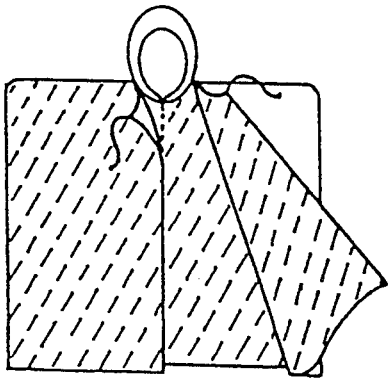
FIG. 8A
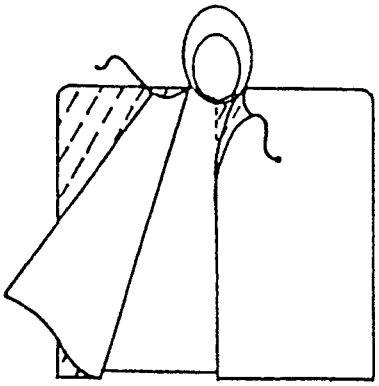
FIG. 8B
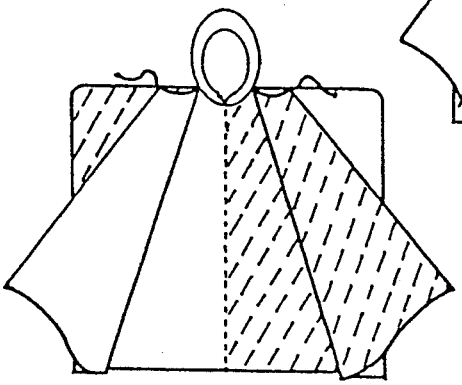
FIG. 8C

CONCEALED DISPLAY FOR A GARMENT

CROSS-REFERENCE TO RELATED APPLICATION

This is a continuation of application Ser. No. 07/817,662, filed on Jan. 7, 1992, now abandoned.

TECHNICAL FIELD

This invention relates to clothing, and more particularly to a piece of clothing that is selectively closed at the front and selectively opened to a fully open position and including a removable display insert such that when the clothing is fully opened, the insert display is viewed, and when the garment is closed, the display is hidden.

BACKGROUND OF THE INVENTION

Various fabrications of clothing have been presented in the past wherein clothing was fabricated such that additional protection was provided the wearer by a separate insert or where messages were displayed at will but were normally hidden from the viewer.

Prior art known to the present inventor which include devices of this nature include U.S. Pat. No. 2,582,772 granted to Egbert on Jan. 15, 1952, which discloses a two-layered garment wherein the exterior garment was of a water-repellant material and the inner lining was of another material for warmth; however, each of the portions of the garment could be worn separately.

U.S. Pat. No. 2,657,389 granted to Gross, Nov. 3, 1953 discloses a rain cape, wherein a supplementary segmented panel is secured over the front of the wearer, whereby the wearer has full use of his arms without exposing the front portion of his body to the weather.

U.S. Pat. No. 2,786,207 granted to Abraham on Mar. 26, 1957 discloses a jacket having an interior liner removably secured such that it looks like a shirt, whereas it is only a collar and a front portion of the shirt.

U.S. Pat. No. 3,381,307 granted to Shingler on May 7, 1968 discloses a garment which includes selectively disclosed or hidden display panels which are secured in a yoke over the shoulders of the garment.

U.S. Pat. No. 4,277,848 granted to Boehland on Jul. 14, 1981 discloses an athletic jersey wherein one half of a colored panel is permanently secured to a jersey and the second half is removably secured such that the removable portion has an alternate color on the back so that the color presentation of the jersey may be quickly changed by raising or lowering the second half.

U.S. Pat. No. 4,864,656 granted to Neese on Sep. 12, 1989 discloses a removable insert assembly for use in combination with a lightweight jacket or vest.

U.S. Pat. No. 4,710,981 granted to Sanchez on Dec. 8, 1987 discloses a garment including a flap with releasable gripping surfaces such that it may be opened to display a message.

U.S. Pat. No. 4,875,237 granted to Cohen on Oct. 24, 1989 discloses a jacket which has selectively displayed messages which may be secured in an upwardly extending vent panel when not in use.

U.S. Pat. No. 4,969,214 granted to Cohen on Nov. 13, 1990 discloses an article of clothing similar to the one disclosed in 4,875,237, but further includes a zipper to secure the bottom of the vent panel.

U.S. Pat. No. 4,985,935 granted to Hur on Jan. 22, 1991 discloses a cap with a hidden display in the visor which may be selectively displayed.

U.S. Pat. No. 4,991,233 granted to Hall on Feb. 12, 1991 discloses a garment which has a visible display and a display which is selectively hidden.

U.S. Pat. No. 4,999,848 granted to Oney on Mar. 19, 1991 discloses a novelty shirt wherein there is a visible message and a selectively hidden message.

French Patent No. 1,464,680 granted to Martin on Nov. 28, 1966, which apparently discloses a jacket-shirt front combination.

DISCLOSURE OF THE INVENTION

With the above-noted prior art in mind, it is an object of the present invention to provide a garment which is selectively closed at the front and includes as an option an insert containing a display which does not restrict the opening of the garment and extends substantially the full width of the garment when it is fully opened.

It is also an object of the present invention to provide a garment having a removable insert at the front thereof wherein the removable insert is reversible.

It is another object of the present invention to provide a garment having a removable display mounted at the front thereof.

It is still another object of the present invention to provide a garment which is wearable with or without the display accessory.

BRIEF DESCRIPTION OF THE DRAWINGS

FIG. 6 discloses another form of the inventive garment in a closed position.

FIG. 7 discloses the second form of the inventive garment as seen in section along lines 7—7 of FIG. 6.

FIG. 8A discloses the second embodiment of the garment in a position partially opened in one direction.

FIG. 8B discloses the second embodiment of the present invention in a partially opened position in a second direction.

FIG. 8C discloses the second embodiment of the present invention in a partially opened position in both directions.

BEST MODE FOR CARRYING OUT THE INVENTION

Figure 1:
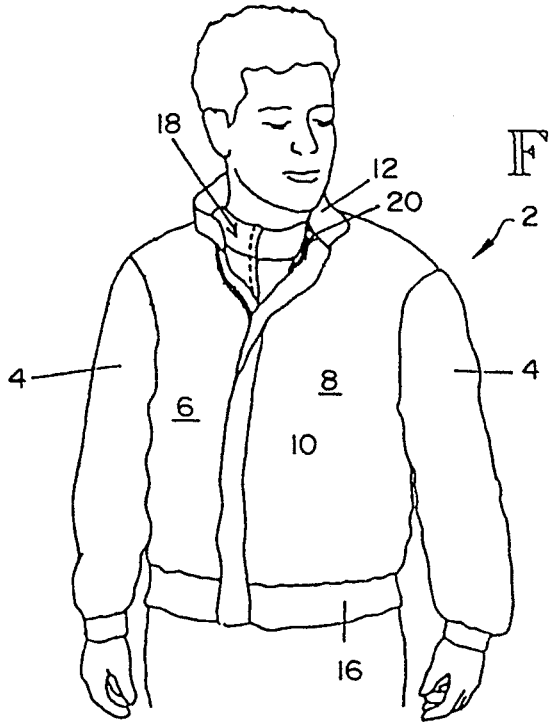
FIG. 1 discloses the inventive garment in the closed position.

As seen in FIG. 1, the preferred embodiment of the present invention is a jacket 2 including sleeves 4, two opposing front panels 6, 8 having a closure 10, a collar 12 and a bottom band 16.

Insert 18 may be seen in this view as well as one of the periphery loops 20.

Figure 2:
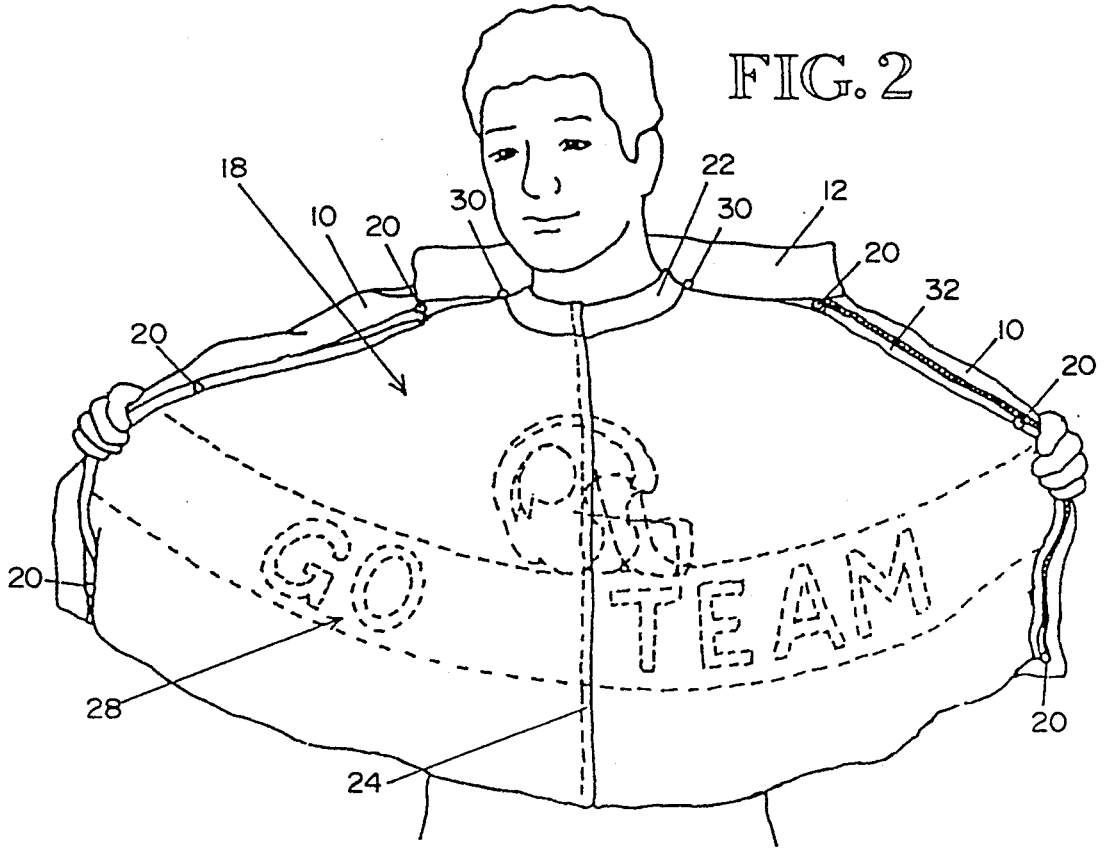
FIG. 2 displays the inventive garment in the open display position.

Reference is now had to FIG. 2, wherein the insert 18 is seen in its open position and includes a collar 22, insert-closing means 24 and the display 28. Likewise seen in this view are the closing means 20, shoulder loops 30 and a hook and loop attaching means 32, as explained hereinafter.

Figure 3:
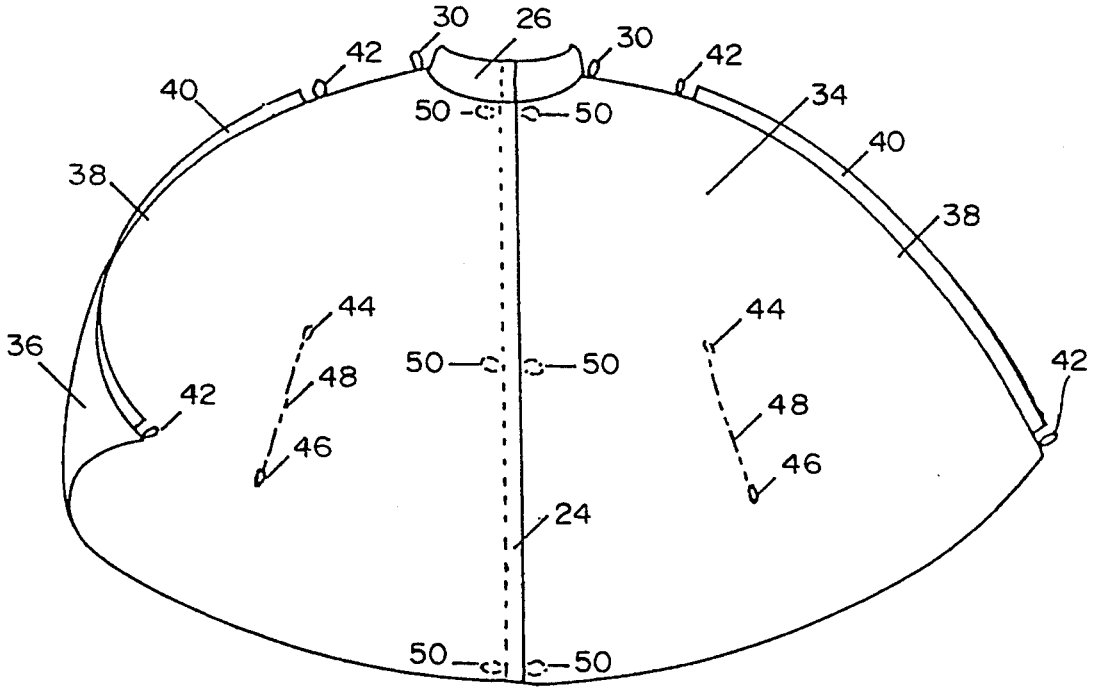
FIG. 3 discloses the display insert.

Reference is now had to FIG. 3, which is the display insert, which includes a primary display surface 34 and a secondary display surface 36. Also seen in this view is a front edge 38 and extension 40, as explained hereinafter. In addition to the shoulder loops 30, there is also seen periphery loops 42 as well as underarm loops 44, underarm reinforced holes 46 which comprise the underarm attachment means 48. Likewise seen in this view are the underside loops 50, which are shown in hidden condition.

Figure 4:
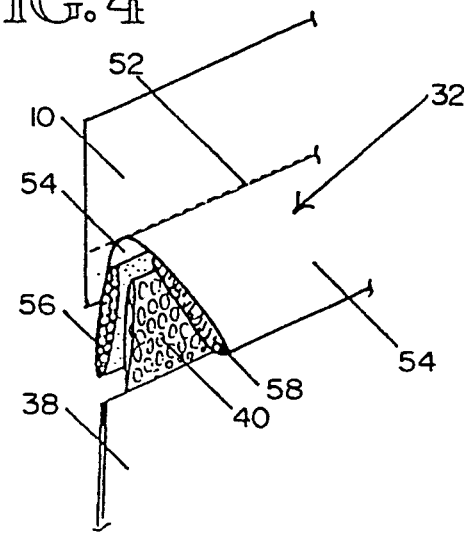
FIG. 4 discloses a means of securing the display in an open position.
Figure 5:
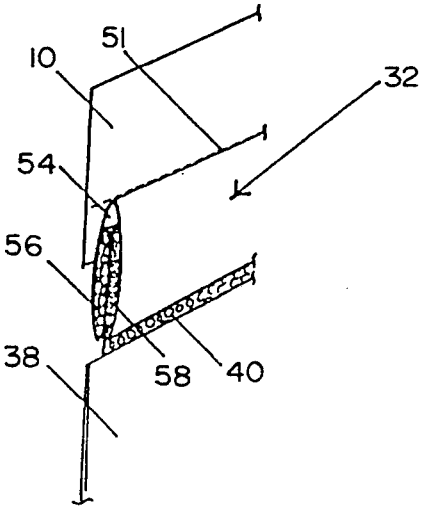
FIG. 5 discloses a means of securing the display in a closed position.

Reference is now had to FIGS. 4 and 5 wherein it can be seen that the front edge 38 of the insert is secured to the front closure band 10 by means of the hook and loop attachment means which comprises a backing attachment 52 secured to the front closure band 10 and a hook and loop backing 54, including a strip of loop fasteners 56 and a strip of hook fasteners 58, which as explained hereinafter are secured through the extension 40. The extension 40 can be made of a variety of fabrics with spaces and sufficient in size and number and of a sufficiently thin material for the hook fasteners and loop fasteners to grip together through the leading edge extension material and can be any one of a variety of fabrics, including lace and netting as well as paper, plastics, metals or other materials including screening with these characteristics. The backing attachment and the fastening strips or bands may be secured in any conventional fashion.

Reference is now had to FIG. 6, wherein another embodiment of the present invention is shown. This embodiment includes the present invention in a cape-like structure 60 having a right front 62 and a left front 64 as well as a right front inside 66 and a left front inside 68. Also seen in this view is the back 70 and a back flap 72 which can be utilized in the folded position as shown or in the extended position as shown in phantom. The back flap is secured in a stowed position by means of fasteners 74.

The cape 60 likewise includes a hood 66 which, as explained hereinafter, may or may not be color-coordinated with the remainder of the cape. As seen in this view, the right side 62 and the left side 64 are of differing colors and the left side of the insert 72 is of a color similar to the right side of the front and the right side of the insert 74 is of a color similar to the left side of the front.

The interrelationship of the various pieces can perhaps best be seen in FIG. 7, which is a sectional view along lines 7—7 of FIG. 6.

A display of how the cape can be used as a communication medium is shown in FIGS. 8A–8C, wherein 8A the left side is partially open and it is obvious that when it is fully opened a wide display of the same color will be shown. An alternate or reverse showing is depicted in 8B, whereas in FIG. 8C with both of the fronts open the full display of the insert is shown so that one would have contrasting colors in a large, single display.

I claim:

1. A garment for selectively conveying information, comprising:

an exterior shell having an interior and exterior surface and a front and back portion for covering the upper torso of the wearer, including at least one selectively closed vertical opening in the front portion of the garment dividing the front portion into two halves, said shell selectively movable from a fully extended, open position wherein the front halves are substantially in line with the back portion of the shell to a closed position; and at least one removable separate piece of material forming a display panel having a top, a bottom and opposing edges extending from a position on one side of and adjacent to the opening of the shell to a position on the opposite side of and adjacent to the opening of the shell, said panel being of a size such that it extends substantially the full width of the shell when the shell is held fully open, whereby the panel may be selectively displayed by opening the front of the garment to a fully extended open position or alternatively be hidden from view when the garment is closed.

2. A garment as in claim 1, wherein the panel is secured to the garment by hook and loop fasteners.

* * * * *